United States Patent [19]

Kurita et al.

[11] 4,248,520

[45] Feb. 3, 1981

[54] ELECTROPHOTOGRAPHIC COPYING APPARATUS WITH IMPROVED FIXING ARRANGEMENT

[75] Inventors: Takaji Kurita, Kawachinagano; Yuji Enoguchi, Higashiosaka, both of Japan

[73] Assignee: Minolta Camera Kabushiki Kaisha, Osaka, Japan

[21] Appl. No.: 947,510

[22] Filed: Oct. 2, 1978

[30] Foreign Application Priority Data

Oct. 12, 1977 [JP] Japan ..... 52/137176[U]

[51] Int. Cl.[3] ..... G03G 15/00

[52] U.S. Cl. ..... 355/3 FU; 355/13; 355/30; 219/216

[58] Field of Search ..... 355/3 FU, 3 SH, 13, 355/16, 30; 219/216, 388, 388 W

[56] References Cited

U.S. PATENT DOCUMENTS

| | | | |
|---|---|---|---|
| 2,852,651 | 9/1958 | Crumrine et al. | 219/216 X |
| 3,053,962 | 9/1962 | Cerasani et al. | 219/216 X |
| 3,666,247 | 5/1972 | Banks | 355/3 FU |
| 3,743,409 | 7/1973 | Fantuzzo | 355/13 |
| 3,861,863 | 1/1975 | Kudsi | 219/216 X |
| 3,922,520 | 11/1975 | Moore | 219/216 |
| 3,965,332 | 6/1976 | Thettu | 219/216 |

*Primary Examiner*—R. L. Moses

*Attorney, Agent, or Firm*—Wenderoth, Lind & Ponack

[57] ABSTRACT

An electrophotographic copying apparatus or copier equipped with an improved fixing arrangement for electrostatically transferring original images onto a copy paper continuously fed from a roll. A heat source including reflectors and a cooling system provided for the fixing arrangement are both arranged to be retracted from their operational positions to stand-by positions when a copying process is interrupted or completed.

In the stand-by positions the heat source is covered by heat insulating material, so that heat from the heat source will not be transmitted to other elements inside the copier during the stand-by mode.

6 Claims, 7 Drawing Figures

ELECTROPHOTOGRAPHIC COPYING APPARATUS WITH IMPROVED FIXING ARRANGEMENT

BACKGROUND OF THE INVENTION

The present invention relates to an electrophotographic copier, and more particularly to a fixing arrangement provided for the electrophotographic copier especially for electrostatically transferring original images having large dimensions such as a plan or the like onto a copy paper which is successively fed from a continuous roll and transported through the copier without any interruption in feeding.

One of the most important requirements for a copier of the above described type is that such copier be provided with the capability of processing tracing paper the copy paper.

However, the tracing paper itself is apt to be curled or wrinkled in certain areas by sudden changes of the ambient temperature or humidity as compared with conventional copy paper. Therefore, even if an automatic feeder for ordinary copy paper operates well in electrophotographic copier, the tracing paper prepared in predetermined dimensions in advance, especially having large dimensions, can not be properly fed due to this deficiency.

Furthermore, the thermal fixing process which is specifically characteristic of the electrophotographic copying process often causes local wrinkles to take place in the tracing paper from the conventional load heating process used for fixing, and which wrinkles sometimes bring about the blocking or jamming of the paper fed to the fusing station of the electrophotographic copier.

Accordingly, to overcome disadvantages tracing paper in a roll form is conventionally utilized for an electrophotographic copier for copying original documents having large dimensions. The tracing paper is fed forwardly in a stretched condition and is passed through a series of image transferring steps, and successive image fixing steps, and finally out into required sheet lengths depending upon the dimensions of the original documents, to provide respective copies.

In the conventional copying process using a roll of tracing paper, the tracing paper to which the original image has been transferred is successively passed through the copier and the paper is rolled again, and hence, the tracing paper in the resultant roll is cut into respective sheets as the roll prepared in advance is used up. Therefore, since the copy paper in roll form is continuously stretched in the copier, the copy paper, even in the stand-by mode, is either subjected to the heater of the fixing device or urged towards a thermal fixing roll when the fixing device incorporated in the copier is a heating roll type device. In connection with the situation described above, one of the specific problems associated with the fixing device is that once the fixing device is heated up to a certain temperature level, it requires a certain period of time before the temperature of the fixing device attains an equilibrium with the surroundings even after the fixing device is de-energized. Therefore, there is a danger that the image bearing portion of the roll of tracing paper, which is normally kept stationary when copies are not being made, may be burned. Furthermore, as described in the foregoing, since the tracing paper is easily contracted or wrinkled even by a slight local temperature rise thereon, even the provision of conventional cooling means, for example, the forced convection type for cooling the fixing device, which cooling means may simply introduce a cooling medium by forced convection in and around the fixing device and the copy paper, can not properly prevent the temperature rise and consequent wrinkles described above.

To overcome the disadvantages described in the foregoing as well as to fuse the image on the copy paper or tracing paper in as short a time as possible, a variety of corrective measures have been proposed.

For example, according to "Heating Apparatus For Electrophotographic Copiers" disclosed in U.S. Pat. No. 3,922,520 patented Nov. 25, 1975, the fusing system comprises an active radiant energy source supported within a housing which may selectively be closed when in a stand-by mode. A portion of the housing also contains a passive heat source such as a suitable insulator material capable of storing large amounts of heat and then releasing such heat in the form of radiation when the housing is electrically actuated to be opened to the atmosphere.

In the conventional arrangment as described above, there is still a danger that the copy paper beneath the apparatus may be charred by the excessive heat radiated from the parts of the apparatus, especially immediately after continuous high speed copying is carried out.

Furthermore, according to the prior art described above, no precautionary measures are taken to prevent the occurrence of the damage, especially the burning of the copy paper, inside the apparatus, which may be especially brought about due to the presence of the passive heat arrangement described above when the electrical power supply is suddenly interrupted during the copying process.

SUMMARY OF THE INVENTION

Accordingly, an essential object of the present invention is to provide an electrophotographic copier equipped with an improved fixing arrangement especially useful for electrostatically transferring original images onto a copy paper continuously fed from a roll, which fixing arrangement excludes all danger of the copy paper being charred or burned under any circumstances.

Another important object of the present invention is to provide an electrophotographic copier of the above described type, which has a simple structure and which is highly efficient.

A further object of the present invention is to provide an electrophotographic copier of the above described type which can be manufactured at low cost.

In accomplishing these and other objects according to one preferred embodiment of the present invention, there is provided an electrophotographic copier equipped with an improved fixing arrangement for electrostatically transferring an original image onto a copy paper continuously fed from a roll through a process including the steps of electrostatically charging a photosensitive member or photoreceptor, exposing the original image onto the photoreceptor which has been preliminarily, electrostatically charged to form an electrostatic latent image thereon, developing the electrostatic latent image to form a visible toner powder image, electrostatically transferring the toner powder image onto the copy paper, fusing the toner powder image on the copy paper to fix such image thereon, and cutting the copy paper bearing the fixed image thereon into predetermined sheet lengths to provide respective copies. More specifically, the electrophotographic copier comprises means for transferring the toner powder image formed on the photoreceptor onto the copy paper, means for fixing the toner powder image on the copy paper by fusing, which means is disposed at a position near the path of travel of the copy paper, at least a pair of transferring rolls for forwardly transporting the copy paper bearing the fixed image thereon, means for cutting the copy paper bearing the fixed image thereon into a predetermined sheet length, which means is disposed after the pair of rolls in the path of travel of the copy paper, means for movably holding the heat source such that the heat source can be selectively moved towards, and retracted from the copy paper, and means for retracting the heat source from the copy paper when the copy paper is not advanced.

More specifically, the means for fixing further comprises at least one reflector for reflecting heat radiated from the heat source towards the copy paper, a pivotally mounted shaft, a member secured to the shaft and arranged to support the reflector and the heat source, and a lever secured to the shaft, and the means for retracting the heat source and with it the reflector comprise a coiled spring to urge the shaft in one pivotal direction thereof, and means maintained in frictional contact with the lever to prevent the shaft from being pivoted by the urging force of the coiled spring.

Furthermore, the means maintained in frictional contact with the lever to prevent the shaft from being pivoted by urging force described above is a reciprocal member, which is mounted on a framework of another part of the apparatus for retracting the means for electrostatically transferring the toner powder image formed on the photoreceptor onto the copy paper from the photoreceptor.

Therefore, when the reciprocal member is reciprocally transferred between a first position and a second position following successive actuations of the apparatus to make copies, the shaft is simultaneously moved from a pivotal position to which it is fully pivoted by the reciprocal member to a pivotal position to which it is fully pivoted by the urging force of the coiled spring.

The means for fixing further comprises a movable duct means for air flow, and a fan for sucking air through the duct means. The movable duct means of heat insulating material is arranged to be movable from an operational position thereof to a stand-by position in which it covers at least the upper portion of the heat source when the apparatus is in a stand-by mode.

By the arrangements described above, the heat source as well as the cooling means can both be retracted from their operational positions to their stand-by positions and, further, the heat source can be covered by the cooling means of heat insulating material when be stand-by mode.

Still furthermore, to exclude the danger that the copy paper will be charred or burned by the sudden interruption of the electric current supply, the shaft described above is further arranged to be slidably driven in the longitudinal direction thereof by a plunger of solenoid actuated by means of a conventional circuit, and which solenoid is ordinarily electrically charged, to cause the frictional contact between the lever and the reciprocal member to be easily disengaged.

By the arrangements described above, the heat source and the reflector are easily moved to their stand-by positions even when the electric current supply is suddenly interrupted.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout the several views of the accompanying drawings.

DETAILED DESCRIPTION OF THE INVENTION

Figure 1:
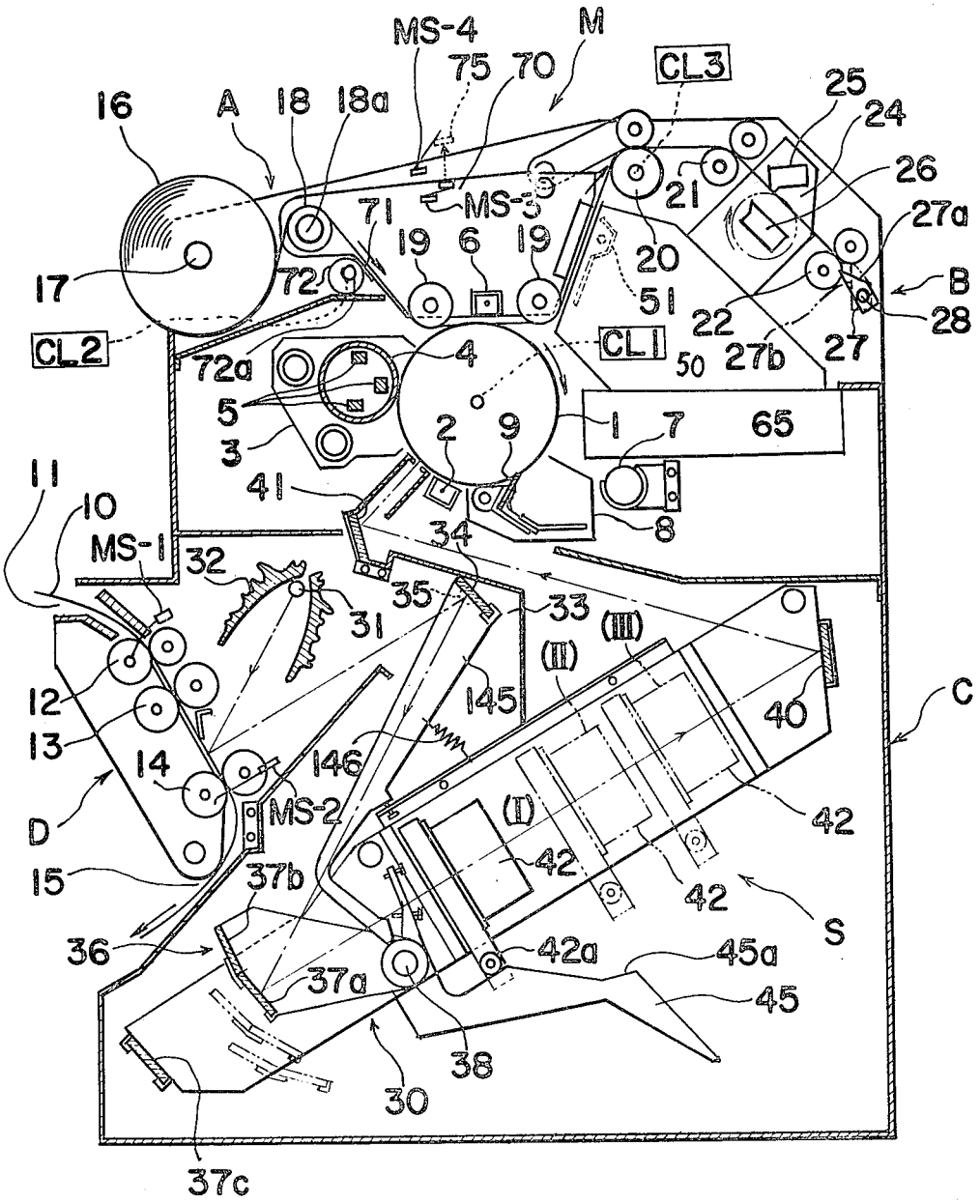
FIG. 1 is a schematic side elevational view of an electrophotographic copier according to the present invention.

Referring now to the drawings, there is shown in FIG. 1, one preferred embodiment of an electrophotographic copier M of the scanning exposure type provided with a fixing arrangement of the present invention. The copier has three copying magnifications of 1 and ½ and ¼ in terms of area ratio, and is especially useful for electrostatically transferring an original document having large dimensions such as a plan onto a copy paper which is successively fed from a roll and transported forwardly through the copier.

The electrophotographic copier described above mainly comprises an optical system S having different magnifications, an original document feeding system D, a copy paper feeding system (A-B), an image transferring system including various processing devices such as a charger 2, a dry processing type developing device 3 provided with a developing sleeve 4 including several permanent magnets 5 therein, a transferring charger 6, a charge erasing lamp 7, and a cleaning device 8 provided with a blade portion 9, a copy paper feeding device including a plurality of rolls and copy paper 16 wound in a large roll around a small rotatable roll or spindle 17, and a fixing means 50 disposed subsequent to the transferring charger 6 etc., around a photoreceptor drum 1 which is arranged to be rotatable clockwise as indicated by the arrow in FIG. 1.

More specifically, the electrophotographic copier of the present invention is provided with an optical system having the following characteristics.

The image of an original document 10 which is brought into a position between respective pairs of transferring rolls 13 and 14, thereby to receive light rays radiated from a lamp 31, is projected onto the surface of the photoreceptor drum 1 by a scanning exposure process, after light rays of the image of the original document 10 are reflected by a first reflecting mirror 34 and a second reflecting mirror are passed through a lens 42, and are further reflected by a third reflecting mirror 40 and a fourth reflecting mirror 41.

The location of the lens 42 is variable approximately within the optical path defined between the second mirror 37 and the third mirror 40, depending upon the predetermined ratio of projection. The movement of the lens 42 to the appropriate positions, i.e., (I) or (II) or (III) as illustrated in FIG. 1 is achieved and controlled by a lever (not shown) driven a conventional manner. Following the movement of the lens 42 is a lever 45 having an edge 45*a* contacting a roller 42*a* mounted on the lens 42 and which is, in turn, fixedly mounted on a pivotal shaft 38. The lever 45 is fixedly secured to the pivotal shaft 38 is further arranged, in turn, to pivotally drive the reflecting mirrors 37*a* and 37*b*, mounted on the pivotal shaft 38. Moreover, the first reflecting mirror 34 is arranged to be pivoted, following the pivotal movement of the lever 45, while the lever 145 is held in a normal condition by a spring 146 as shown in FIG. 1.

By the arrangement described in the foregoing, the reflecting mirror 37*a* is disposed in the optical path when the lens 42 is located in the position indicated by (I) in FIG. 1, while the reflecting mirror 37*b* is correspondingly disposed in the optical path when the lens 42 is located in the position indicated by (II). However, when the lens 42 is located in the position indicated by (III), the fixed reflecting mirror 37*c* is utilized for reflecting the image along the optical path.

In the course of the feed of the original document 10 to be copied, the original document 10 is placed on an inlet platform 11 disposed at the front left portion of a casing C of the copier M, with the surface bearing the image to be copied being directed upward, and is successively downwardly fed into the inside of the copier M by means of three successive pairs of electrically driven transporting rolls 12, 13 and 14 positioned at proper interval to transport the original document 10 forwardly and to feed the original document 10 to an outlet platform 15 to be discharged.

In the course of movement of the original document 10, the original document 10 is first scanned by light radiated by the lamp or the light source 31 covered by a shade 32 and constituting a portion of the optical system S mentioned in the foregoing.

Images reflected from the original document 10 are projected onto the photoreceptor surface on the photoreceptor drum 1, after having been successively reflected by a series of the first reflecting mirror 34, a second reflecting mirror 37*a* or 37*b* or 37*c*, and through the lens 42, and further reflected by the third reflecting mirror 40, and a fourth reflecting mirror 41 in a manner as shown in FIG. 1, which mirrors and lens as a whole constitute the optical system S.

The leading edge portion of the copy paper wound in a large roll around a small rotatable roll 17 is drawn from a copy paper feeding station A of the copier M so as to be continuously stretched over respective guide rolls 18 and 19, and is further stretched through and held by respective pairs of transferring rolls 20 and 21 and 22 forwardly positioned in the copy paper feeding device.

Along the path of the copy paper 16 are disposed in succession; a non-enclosed fixing device 50 having therein an infrared-ray radiant energy heater 51, a cutter means having a fixed cutter 25 and a movable cutter 24 which arranged to be actuated and cooperate with cutter 25 for cutting the copy paper 16, and a guide board 27 pivotally mounted on a shaft 28, to properly set the discharging direction of the copied sheet which has been cut into predetermined sheet lengths in the manner described above.

When the original document 10 is to be copied on the copy paper 16 especially at the original scale thereof, the respective feeding speeds of the original document 10 and the copy paper 16 are in synchronization with the peripheral speed of the photoreceptor drum 1, and the image of the original document 10 formed as an electrostatic latent image on the surface of the photoreceptor drum 1 which has been charged in advance by the charger 2 and subsequently formed as a toner powder image by means of the developing device 3, is transferred onto the copy paper 16 by the discharging effect produced by the transferring charger 6.

The image transferred onto the copy paper 16 is further fused so as to be fixed thereon by energy radiated by the heating device 51 which is included in the fixing device 50, and subsequently the leading portion of the copy paper 16 is cut off and is guided by an edge portion 27*a* of the guide board 27 to an upper tray (not shown) as a copied sheet.

More specifically, the copy paper 16 is fed in synchronization with the movement concerning the toner powder image on the photoreceptor drum 1 to the transferring position by means of the respective pairs of guide rolls 19, while the copy paper 16 is held in contact at the transferring position with the photoreceptor drum 1 by means of the guide rolls 19 for transferring the toner powder image onto the copy paper 16.

After the toner powder image has been transferred thereonto, the copy paper 16 is freed from contact with the photoreceptor drum 1 and is moved forwardly through the fixing device until the portion bearing the image is passed through the cutter 24 and then cut off. The portion of the copy paper 16 initially stretched from the cutter 24 to the transferring charger 6 is not utilized for the copying process at all and is discharged to a lower tray (not shown) by the guiding actuation of the edge portion 27*b* of the guide board 27 when the guide board 27 is slightly pivoted clockwise with respect to the shaft 28 (as shown by dotted lines in FIG. 1).

The photoreceptor drum 1 having finished a transferring process, continues to rotate, so that not only the residual electric charge on the surface thereof is erased by the rays radiated from the charge erasing lamp 7, but also the residual toner powder is removed by the scraping action of the blade 9 constituting the cleaning device 8 as the surface of the drum moves past it.

An the arrangement of the electrophotographic copier of the above described type, the synchronized forward feeding of the copy paper 16 in synchronization with the rotation of the photoreceptor drum 1 is brought about due to the fact that the copy paper 16 extend the full length of the path of travel of the copy paper from the copy paper feeding station A to the copy paper discharging station B. Therefore, there is much copy paper 16 wasted in the preparation of a copy. This waste is reduced by the following arrangement specifically included in the embodiment of the present invention shown in FIG. 1, wherein the respective rolls 19 disposed on opposite sides of the transferring charger 6 for urging the copy paper 16 towards the photoreceptor drum 1, and the transferring charger 6 are fixedly secured to a framework 70 which is pivotally mounted on a shaft 18*a* as shown in FIG. 1, and a lever 71 is secured to the framework 70 at a predetermined position between the shaft 18*a* and the forward roll 19 so that the framework 70, as a whole can be pivoted by an upwards thrust on the lever 71 secured thereto by movement of an eccentric cam 72 driven in a conventional manner.

By the arrangement, the copy paper 16 can be held stationary out of contact with the photoreceptor drum 1, where necessary, with the whole framework 70 being lifted by the cam mechanism in the manner as described above. When the copying process is to be in operation, the leading portion of the copy paper drawn from the roll thereof at the feeding station A is either forwardly extended to the discharging station B, passing around both rolls 19, the fixing device 50, the transferring rolls 20 and 21, the cutter 24 and the discharging rolls 22 respectively, or wound on a winding reel which is most forwardly positioned (not shown).

Furthermore, on the contrary to the condition as shown in FIG. 1, the whole framework 70 including the transferring charger 6, the urging rolls 19, and the copy paper 16 can be stationarily maintained at the raised position thereof after an upwards pivotal movement with respect to the shaft 18*a* so as to be spaced from the photoreceptor drum 1 by the functional engagement between the lever 71 and the periphery of the cam portion of the cam having the greatest eccentricity. A micro-switch (MS-4) is simultaneously actuated to an ON state by an actuating member 75 mounted on the framework 70 and a micro-switch MS-3 is, at the same time released so as to be switched to an OFF state.

A main motor (not shown) for the copier is brought into an operational condition when a main switch (not shown) is actuated to energize the main motor, and thereby the original document 10 introduced from the inlet platform 11 is forwardly transferred by a series of transportation rolls 12, 13, and 14 as described in the foregoing, and a micro-switch (MS-1) is moved to the ON state thereof by the leading portion of the advancing original document 10.

Figure 2:
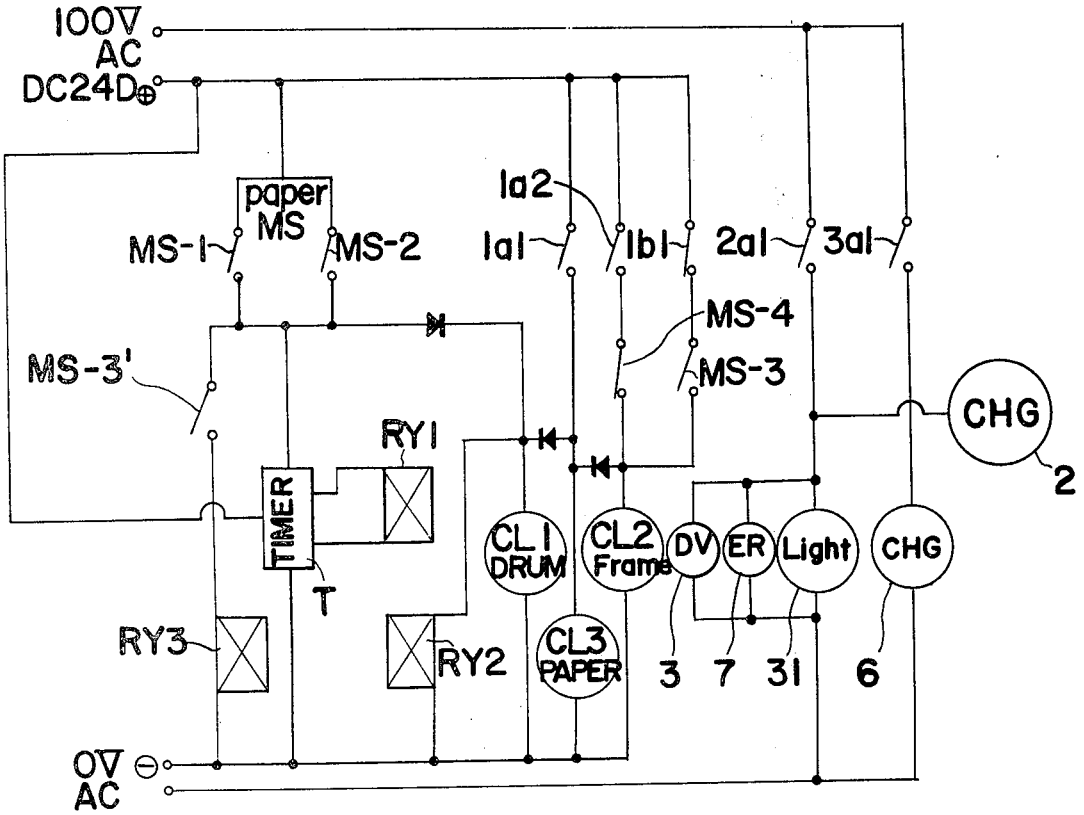
FIG. 2 is an electrical circuit diagram illustrating various electrical elements and devices employed in the copier of FIG. 1.

As specifically shown in FIG. 2, the closing of the micro-switch MS-1 to the ON state thereof energizes a timer T and relay RY2 and actuates clutch CL-1. The photoreceptor drum 1 driven by the main motor through the clutch CL-1 begins to rotate clockwise. Simultaneously, the charger 2 and the developing device 3 are brought into their respective operational conditions, and the light source 31 and the charge erasing lamp 7 are both energized by closing of switch 2*a*1 and 3*a*1 by relays RY2.

During the rotational movement of the photoreceptor drum 1, the photoreceptor drum 1 is first electrically charged by the charger 2 and thereby the image of the original irradicated by the light source 31 is formed on the surface of the photoreceptor drum 1 as an electrostatic latent image by the exposing process through the optical system S described in the foregoing, and this image is subsequently converted into the toner powder image when the image portion is successively passed by the developing device 3.

When the leading portion of the toner powder image has been transported to a position immediately in front of the transferring charger 6, the timer T actuates relay RY1 closing switches 1*a*1, 1*a*2 and opening normally closed switch 1*b*1. Electromagnetic clutch CL-2 is energized to connect the main motor to cam shaft 72, and the cam 72 is rotated for pivoting the framework 70 around shaft 18*a* until the cam 72 occupies a position in which the lever 71 is engaged by the portion of the cam having the least eccentricity. Thus, the supporting framework 70 is pivoted with respect to the shaft 18*a* so as to be positioned at the lower position thereof as shown in FIG. 1.

Following the termination of the lowering movement of the framework 70 to the position in which the rolls 19 are indirectly contacting the photoreceptor drum 1 with the copy paper 16 interposed between the respective rolls 19, and the photoreceptor drum 1, the micro-switch (MS-4) is switched to an OFF condition and the micro-switch (MS-3) and micro-switch MS-3′ are switched to the ON condition by the actuating member 75, deenergizing clutch CL-2 so that the cam 72 is prevented from further rotation past 180° from the initial position, and energizing relay RY3.

As soon as the steps described above are completed, the transporting of the copy paper 16, which is now kept urged against the drum as described above, is started by the electromagnetic clutch CL-3 which is secured to the shaft of one of rolls 20 and the connection of a connector switch ($3a_1$) is closed by the relay (RY3) to cause the transferring charger 6 to be electrically actuated for transfer of the toner powder imaged formed on the surface of the photoreceptor drum 1 onto the copy paper 16. The toner powder image transferred onto the copy paper 16 is successively fused to fix it and the copy paper 16 bearing the image is further transported through the fixing device and then the copy paper 16 is discharged from the copier M at the discharging station B by means of the pair of the transferring rolls 22.

After the completion of the image transferring process, the residual electric charge on the surface of the photoreceptor drum 1 is discharged by means of the light from the charge erasing lamp 7, while the residual toner powder on the surface of the photoreceptor drum 1 is removed by the blade 9 of soft material constituting the cleaning device 8 by frictional contact between the surface of the drum and the edge portion of the blade.

Furthermore, as the original document 10 to be copied passes through the original document feeding system D, the trailing portion of the original document releases the micro-switch (MS-2) as well as the micro-switch (MS-1) disposed at a position at the trailing end with respect to the feeding direction to the OFF condition. Therefore, the charging circuit for energizing the charger 2, the developing device 3, the radiation light source 31, the erasing light lamp 7, and the photoreceptor drum 1 are electrically cut off only after a delay of the predetermined time due to an RC circuit constituting the timer T.

Furthermore, the electromagnetic clutch CL-2 is electrically actuated to the ON state and is electrically actuated to the ON state through the normally closed switch 1b1 and now closed micro-switch MS-3, and the subsequent rotation of the cam 72 causes the successive, upward movement of the framework 70 as a whole with respect to the shaft 18a as the move eccentric portion of the cam 12 begins to frictionally drive the lever 71 as described in the foregoing, so that the copy paper 16 is freed from the contact with the photoreceptor drum 1. In connection with the upward movement, the actuating member 75 provided for the supporting framework 70 electrically actuates the micro-switch MS-4 to the ON condition and the micro-switch MS-3 to the OFF condition to interrupt the the electromagnetic clutch CL-3, and, thereby stop the rotation of the transferring roll 20 and then the forward feeding of the copy paper 16. When the micro-switch MS-3 is opened, the cam 72 is stopped after rotation of 180° .

The copy paper 16 with the original image is successively treated by the fixing device 50 which will be fully described hereinbelow so that the image is permanently fixed on the copy paper.

Figure 3:
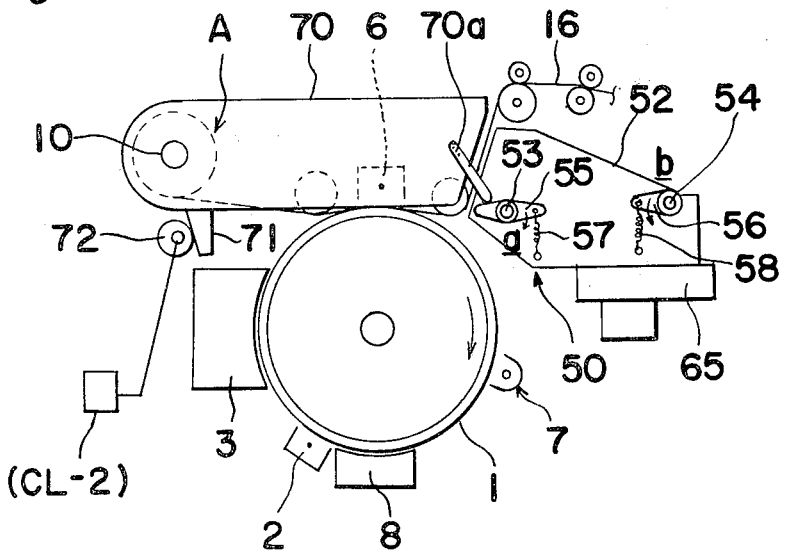
FIG. 3 is a schematic side view, on an enlarged scale, of a driving connection among a copy paper fed from a roll, a discharger and means for fixing including a heat source, a reflector and cooling duct means, which is employed in a copier provided with a modified cam driving mechanism and a paper feeding station.
Figure 4:
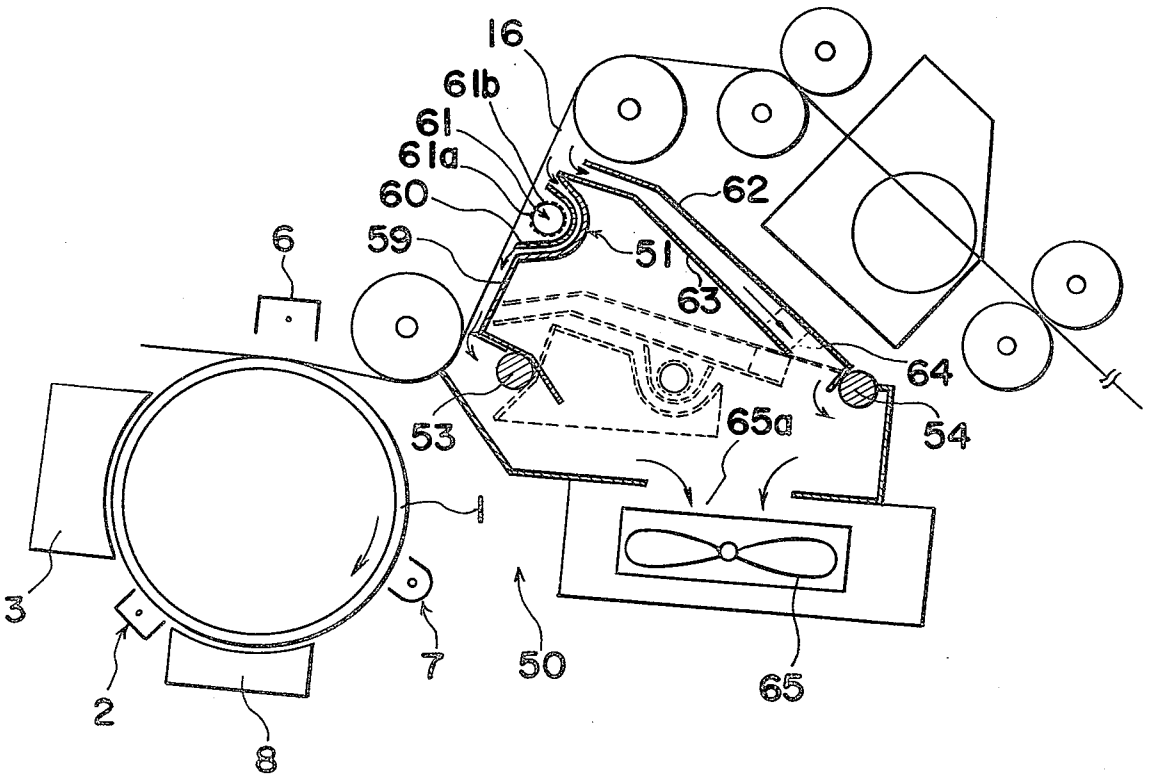
FIG. 4 is a partial side view, in section, on an enlarged scale, particularly showing the movement of the heat source, the reflector and cooling duct means from an operational position to a retracted stand-by position as well as induced flows of air, which are both employed in the copier of FIG. 1.

Referring now to FIGS. 3 and 4, there is shown the fixing device 50, according to the present invention, which has the following structure and characteristics, although the cam driving mechanism has been slightly modified as will be specifically described hereinbelow, the embodiment shown in FIG. 1.

Figure 6:
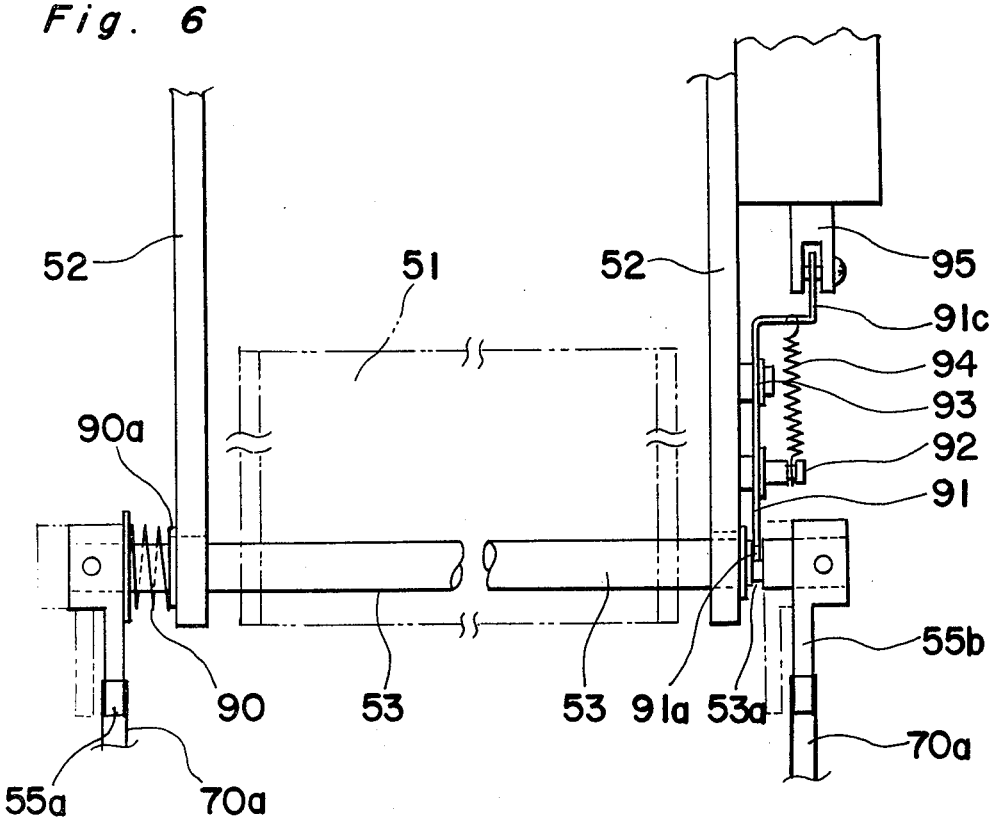
FIG. 6 is a fragmentary side view, on an enlarged scale, particularly showing a driving mechanism for the shaft for shifting the heat source, the reflector and cooling duct means to their stand-by positions, which is employed in the copier of FIG. 1.

Respective levers 55 and 56 are fixedly mounted on the respective shafts 53 and 54, which shafts are rotatably mounted on a fixing device framework 52 which is specifically shown in FIG. 6, respectively. Furthermore, as specifically shown in FIG. 3, one end of the lever 55 has a spring 57 secured to one free end so that the lever 55 is urged in the direction as indicated by the arrow a in FIG. 3, while the free end of the lever 56 has a spring 58 secured thereto so that the lever 56 is in the direction indicated by the arrow b in FIG. 3. Engaged with the other end of the lever 55 is an arm 70a fixedly attached to the framework 70 at one end thereof is arranged to touch at the other end so as to prevent the pivotal movement of the lever 55 in the direction indicated by the arrow a when the framework 70 occupies the lower position as described earlier, in which the copy paper 16 is being forwardly transported while being urged towards the surface of the photoreceptor drum 1.

More specifically, as shown in FIG. 4, inside the framework 52 of the fixing device 50, there is provided a heating device 51 or an infrared-ray radiant energy heater for the fixing process which comprises a supporting member 59 fixedly secured to the shaft 53 and having a curved portion, a source 61 of radiated heat mounted on the supporting member 59, and a reflector 60 formed in an appropriately curved shape for efficiently reflecting the radiant heat from the source 61 to the copy paper 16 passing through the fixing device 50. The reflector 60 can be spaced from the curved portion of the supporting member 59 to define a path for cooling medium between it and the curved portion of the supporting member 59. The curved portion of the supporting member 59 can also be a reflecting member. Furthermore, a pair of heat insulating members 62 and 63 interconnected by a member 64 are secured to the shaft 54 at one end thereof and are pivotable as one unit following the pivotal movement of the shaft 54.

In this arrangement, the pair of heat insulating members 62 and 63 define with the respective surfaces of the framework 52 an air duct for a flow of air induced by a fan unit 65 inside the fixing device 50 from the outside of the copier M.

As described in the foregoing, although the shaft 54 is urged counterclockwise by the spring 58, the pivotal movement of the shaft 54 is prevented when the leading portion of the member 63 is in contact with a portion of the heating device 51 in the positions as shown in FIG. 4.

The fan unit 65 is accommodated in a compartment provided with an inlet 65a and disposed in the lower portion of the fixing device 50, and draws in air from the inlet 65a for directing the air flow induced in the fixing device to the outside as shown by arrows in FIG. 4. The fixing device 50 operates as follows.

When the framework 70 is lifted up to an upper position, following the pivotal movement of the cam 72, not only is the copy paper 16 no longer urged into contact with the surface of the photoreceptor drum 1, but also the forward transfer of the copy paper 16 is stopped. Furthermore, during the upward movement of the framework 70, the arm 70a fixedly secured to the framework 70 is also lifted upwards, and the lever 55 is released from the frictional contact with the leading edge of the arm 70a, and is thus pivotally moved in the direction indicated by the arrow a in FIG. 3 by the spring 57. The pivotal movement of the lever 55 brings about the pivotal movement of the shaft 53, to which the above-mentioned lever 55 is fixedly secured, as well as the clockwise pivotal movement of the supporting member 59 secured to the shaft and the members mounted thereon such as the heat source 61 and the reflector 60 so as to be moved away from the copy paper 16 as shown by dotted lines in FIG. 4.

In connection with the above mentioned pivotal movement of the heating device 51, the leading edge of the heat insulating member 63 engaged with the supporting member 59 is set free following the downward pivotal movement of the supporting member 59, whereby the shaft 54 is also made freely movable and is pivoted counterclockwise with the members mounted thereon, i.e., the heat insulating members 62 and 63 by the spring force normally exerted by the spring 58 and the lever 64.

The lower position occupied by the heat insulating members 62 and 63 is also illustrated by dotted lines in FIG. 4, and which lower position is relatively subjected to the vertically transporting distance caused by the framework 70 though the frictional contact between the lever 70a and the lever 55 is arranged to be steadily kept.

The radiant heat source 61 of the heating device 51 is a quartz lamp radiating light rays close to infrared rays and covered with a film of nickelchrome alloy 61a, which absorbs the radiant heat energy radiated from the filaments so as to be maintained in an highly heated condition and thus which can radiate infrared rays of long wavelength. However, once the heat source or the reflector or the like comprising the heating device is heated up to a certain temperature level by heat sources regardless of the type, it can not be rapidly cooled and generally requires a certain period of time before the temperatures thereof reach an appropriate equilibrium temperature with the outside surroundings even after the heat source is de-energized. Therefore, according to the present invention, the specific defects of the heating device 51 described above are overcome by making the whole heating device 51 movable to the position as illustrated by the dotted lines with the heat insulating members 62 and 63 also moved from their normal position as illustrated by the dotted lines, so that any heat from the heating device 51 having heat remaining in it can be avoided. Furthermore, air is caused to flow as a cooling medium between the heat insulating members 63 and 64 so that the heat radiated from the heating device 51 is forcibly removed by the air flow induced by the fan unit 65.

More specifically, when the heating device 51 is in its operational condition as illustrated by full lines in FIG. 4, the air flow induced by the fan unit 65 is mainly introduced into a path between the supporting member 59 and the reflector 60, to prevent the overheating of the reflector 60 as well as the path along which the copy paper 16 having the transferred image thereon moves, to effectively preheat the copy paper 16 before the fixing process. Furthermore, the heat insulating members 62 and 63 extending almost parallel to an above the heating device 51 also prevent undesirable heat transmission from the source 61 having a high heat capacity to the means disposed in the upper portion of the copier.

When the framework 70 is returned to the downward position, reverse movements of the parts of the heating device 51 are produced and the heating device 51 as well as the heat insulating boards are both moved up to their respective operational positions illustrated by the full lines from the positions illustrated by the dotted lines in FIG. 4. The duct for the induced air flow, which is formed by the pair of heat insulating members 62 and 63 is brought back to its operational position following movement of the supporting member 59, since the portion of the reflector or the supporting member and a portion of the duct are in contact with each other during the movement mentioned above.

As is apparent from the foregoing embodiment of the present invention, the movement of the heating device 51 is carried out in synchronism with the vertical movement of the framework 70 which corresponds to the movement of the copy paper 16 into and out of contact with the photoreceptor drum 1. However, the respective movements mentioned above can be, of course, be carried out independently.

Figure 5:
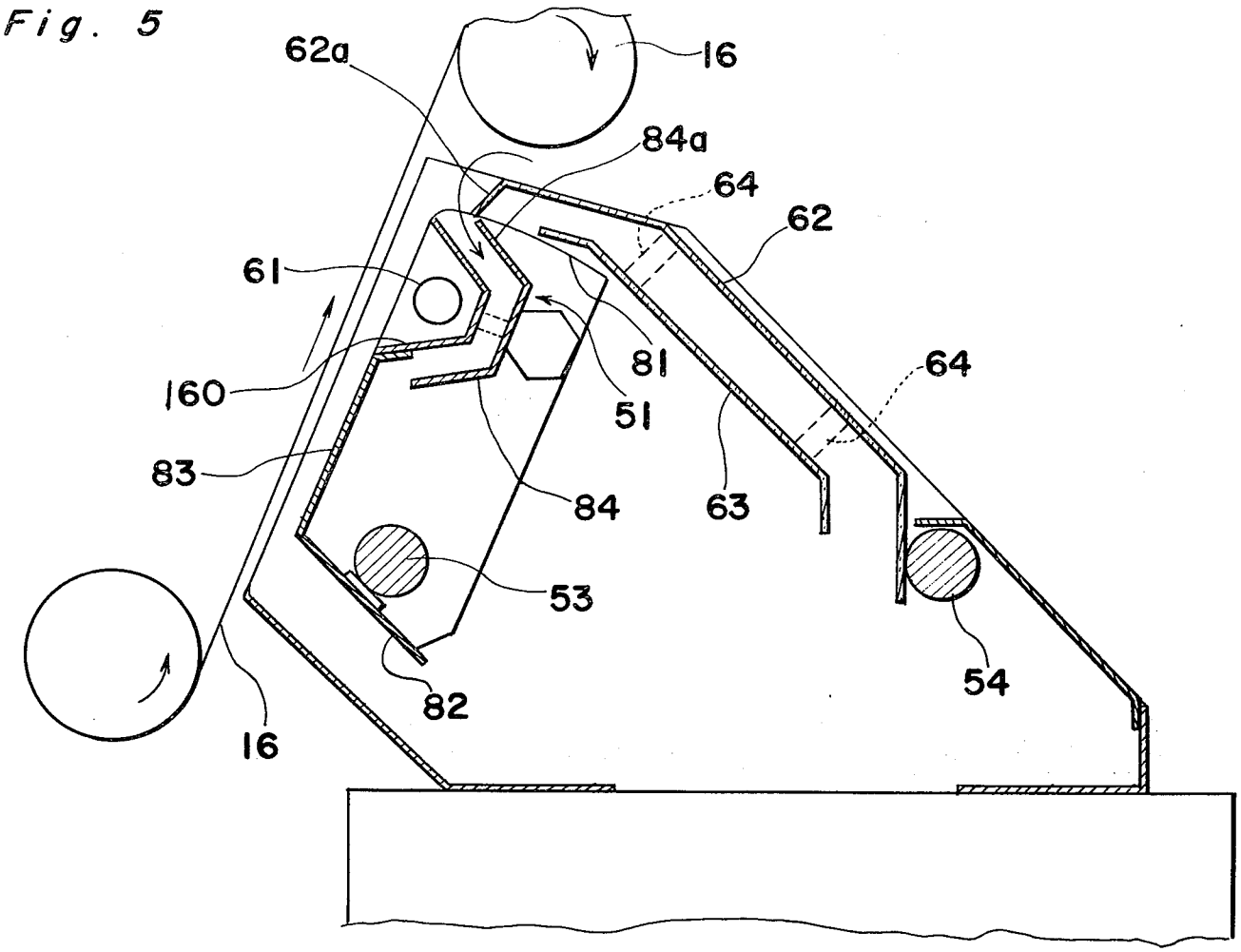
FIG. 5 is a fragmentary side view, in section, on an enlarged scale, showing a modification of the arrangement of the cooling duct means.

FIG. 5 shows a modified embodiment of the fixing device, wherein the structure of the heating device 51 and the heat insulating members 62 and 63, respectively, are modified.

Between the respective locations of a pair of side members 81 and 82, which are coupled with the shaft 53 and pivotally movable with respect to the shaft 53, the heat source 61 and a first reflector 160 are disposed and respectively secured to the boards 81, and, a dividing wall 83 is secured to the first reflector 160 at one end thereof. Furthermore, a second reflector 84 is secured to the first reflector members 61 and is spaced behind reflector 160. These respective reflectors 160 and 84 are made of, for example, electrolytically polished aluminum, and the space formed between them as illustrated in FIG. 5 is utilized as an air flow passage.

The heat insulating member 62 is fixedly secured to the shaft 54 at one end thereof, while the other heat insulating member 63 is fixedly connected with the heat insulating member 62 by interconnecting members 64 in a manner such that a space is formed between them which can also be utilized as an air flow passage.

The leading portion **62*a* of the heat insulating member 62 is inwardly curved as shown in FIG. 5 so as to face one end portion 84*a* of the reflector 84 when the heating device 51 is located at its operational position. By this arrangement, the induced air flow is quite effectively guided into the passage formed between the respective first and second reflectors 160 and 84**, and thus the cooling efficiency is improved to a large extent.

Other features and structual arrangements of this modified embodiment are generally similar to those of the embodiment of FIGS. 1 to 4. Therefore, a detailed description thereof is omitted for the sake of brevity.

Figure 7:
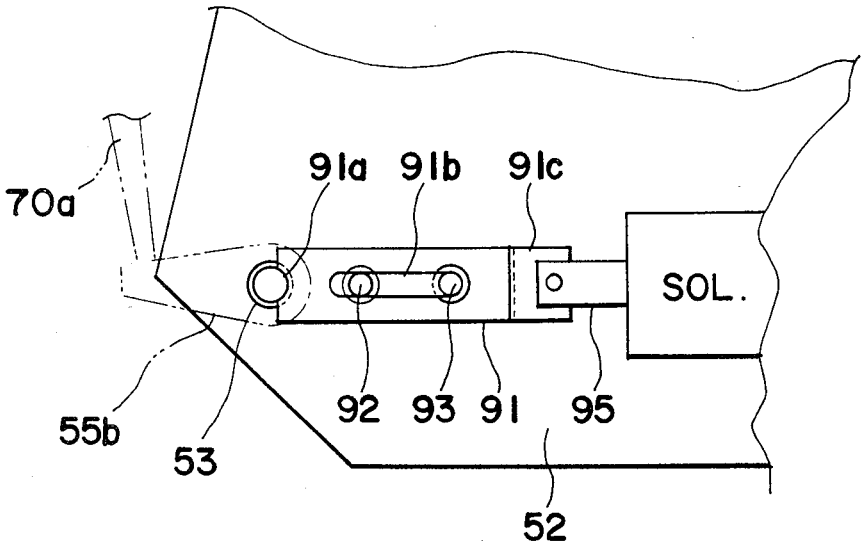
FIG. 7 is a fragmentary side view, on a greatly enlarged scale, particularly showing mechanical connections between members employed in the driving mechanism of FIG. 6.

Referring now to FIGS. 6 and 7, there is shown another modified embodiment of the present invention. In the above description the mechanism for the synchronized movements of the heating device 51 and the feeding system of the copy paper, including the transferring charger 6, is fully described. A further modification provides for independent movement of the heating device 51, especially the retracting movement from the copy paper.

The modified arrangement is required because the forward feeding of the copy paper may be interrupted by an unexpected event such as a sudden interruption of the electric power supply or the like, in which case the fixing device, including the heating device would still be maintained in close contact with the copy paper.

According to the modified embodiment shown in FIGS. 6 and 7, the shaft 63 is pivotally secured to the framework 52, and the heating device 51 is fixedly secured to the shaft 53 at one end thereof in a manner such that the shaft 53 is urged clockwise by a torque which provided by the relative disposition of the heating device 51 relative to the shaft 53. The heating device 51 of the fixing device 50 is maintained in the working position when the clockwise movement of the shaft 53 is prevented by the frictional contact of the respective levers **55*a* and 55*b* fixedly secured to the shaft 53 and the leading edge of the respective arms 70*a* which are fixedly secured to the framework 70 of the transferring charger 6 in the same manner as described earlier, and the clockwise urging of the shaft 53** is brought about by the torque described above and not by a spring force in this modified embodiment.

Furthermore, as shown in FIG. 6, interposed between the framework 52 and the lever **55*a*, which is fixedly secured to one end portion of the shaft 53, is a coiled spring 90 mounted on the shaft 53, and urging the lever 55*a* towards the left. However, because the framework 52 is pivotally mounted on bushings 90*a* which are mounted on the shaft 53, the resilient force received by the leading edge of the bushing 90*a* will, in turn, cause the relative leftward movement of the shaft 53 with respect to the framework 52, unless it is prevented. Therefore, the other end of the shaft 53 is provided with a groove 53*a*, in which the leading edge 91*a* of a stop 91 having a rounded recess therein is inserted, so that the shaft 53 is held against the froce of the spring 90. As specifically shown in FIG. 7, the stop 91 has a slot 91*b*, through which a pair of bolts 92 and 93 mounted on the framework 52 extend. The reference numeral 94 designates a tensioned spring having one end secured to the bolt 92 and the other end connected with an arm portion of the stop 91, whereby the stop is slidably urged on the pair of bolts towards the groove 53*a* in the shaft 53**.

The other end **91*c* of the stop is connected with the forward end of a plunger of a solenoid 95. Therefore, by this arrangement, when the solenoid is energized, the stop 91 is drawn toward the solenoid against the spring force of the spring 94 and thereby, the leading edge 91*a* of the stop 91 having the round recess at the forward end thereof is withdrawn from the groove 53***a* in the shaft 35.

Accordingly, the shaft 53 is freed and is moved towards the left to occupy the position illustrated by the dotted lines in FIG. 6, whereby the lever 55*a* and the arm 70*a* as well as the lever 55*b* and the arm 70*a* are simultaneously disengaged, and subsequently the heating device 51 is freely pivoted to inactive position shown by the dotted lines in FIG. 4 due to the torque arrangement described above and also causes the rotational movement of the shaft attached thereto.

The electric circuit comprising the solenoid further includes a capacitor (not shown) which is electrically charged during the normal copying process, and when any undesirable circumstances occur, the retraction process of the heating device from the operational position thereof is possible only if the capacitor is discharged to cause the solenoid to be actuated. Furthermore, conventional means to detect either the sudden interruption of the electric power supply or the abnormal feeding of the copy paper can be provided. For example, the sudden interruption of the electric power supply can be detected by a conventional current detecting circuit, while the unsteady or abnormal feeding of the copy paper can be detected either by microswitch curcuits provided at proper intervals along the path of the copy paper or by the comparison of the rotational speed of the roll of the copy paper with its steady average speed.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic copier for transferring an original image onto a copy paper continuously fed from a roll by a process including the steps of electrostatically charging a photoreceptor, exposing said original image onto said electrostatically charged photoreceptor to form an electrostatic latent image, developing said electrostatic latent image to form a toner powder image, electrostatically transferring said toner powder image onto said copy paper, fusing said toner powder image on said copy paper to fix it thereon, and cutting said copy paper carrying the fixed image thereon into successive lengths to provide respective copies, said electrophotographic copier comprising: means for transferring said toner powder image formed on said photoreceptor onto said copy paper; means for fixing said toner powder image on said copy paper by fusing, said fixing means at least including one heat source disposed in a position near the path of travel of said copy paper; means for holding said heat source for selective movement of said heat source towards and away from said copy paper; means for retracting said heat source from said copy paper at least when said copy paper is not transported forwardly, a reflector for reflecting heat radiated from said heat source towards said copy paper, at least one movable duct means through which air can flow, means for drawing air to induce air flow through said duct means, said movable duct means being movable from an operational position thereof to a standby position thereof in which it covers at least the upper portion of said heat source when said heat source is moved to a position in which it is retracted from said copy paper; at least one pair of transferring rolls for forward transporting of said copy paper carrying said fixed image thereon; and means for cutting said copy paper carrying said fixed image thereon into sheet-size lengths, said cutting means being disposed at a forward position with respect to the position of said pair of rolls in said path of travel of said copy paper.

2. An electrophotographic copier as claimed in claim 1, in which said means for fixing further comprises a first shaft pivotally mounted thereon, a member for supporting said reflector fixedly secured to said first shaft so as to be pivotally moved, and a second shaft pivotally mounted on said means and to which said duct means is fixedly secured so as to be pivotally moved, a portion of said reflector and a portion of said duct means being in a frictional contact with each other for moving said duct means to the operational position thereof when said heat source is moved from said position retracted from said copy paper to an operational position near said copy paper.

3. An electrophotographic copier as claimed in claim 1, wherein said reflector comprises a pair of reflecting members spaced one behind the other relative to define an air flow passage between said pair of reflecting members through which air is drawn by said means for drawing air when said heat source is disposed at said operational position.

4. An electrophotographic copier for transferring an original image onto a copy paper continuously fed from a roll by a process including the steps of electrostatically charging a photoreceptor, exposing said original image onto said electrostatically charged photoreceptor to form an electrostatic latent powder image, electrostatically transferring said toner powder image onto said copy paper, fusing said toner powder image on said copy paper to fix it thereon, and cutting said copy paper carrying the fixed image thereon into successive lengths to provide respective copies, said electrophotographic copier comprising: means for transferring said toner powder image formed on said photoreceptor onto said copy paper; means for fixing said toner powder image on said copy paper by fusing, said fixing means at least including one heat source disposed in a position near the path of travel of said copy paper; a reflector for reflecting heat radiated from said heat source towards said copy paper, a shaft pivotally mounted on said fixing means, a reflector supporting member fixedly secured to said shaft and supporting said reflector and said heat source, a lever fixedly secured to said shaft, said reflector supporting member being mounted on said shaft with the center of gravity of said reflector supporting member, said heat source and said reflector being positioned for urging said shaft to rotate in one direction for pivoting said heat source away from the path of the copy paper, and a reciprocal member contacting said lever and reciprocally movable between a first position during operation of the apparatus and a second position upon cessation of operation of the apparatus, and in said first position engaging said lever for blocking the movement of said shaft so that said shaft is blocked against rotation due to the weight of said reflector supporting member, said reflector and said heat source, and in said second position freeing said lever for permitting said shaft to pivot as far as it can in said one direction due to the weight of said reflector supporting member, said reflector and said heat source, at least one pair of transferring rolls for forward transporting of said copy paper carrying said fixed image thereon; and means for cutting said copy paper carrying said fixed image thereon into sheet-size lengths, said cutting means being disposed at a forward position with respect to the position of said pair of rolls in said path of travel of said copy paper.

5. An electrophotographic copier for transferring an original image onto a copy paper continuously fed from a roll by a process including the steps of electrostatically charging a photoreceptor, exposing said original image onto said electrostatically charged photoreceptor to form an electrostatic latent image, developing said electrostatic latent image to for a toner powder image, electrostatically transferring said toner powder image onto said copy paper, fusing said toner powder image on said copy paper to fix it thereon, and cutting said copy paper carrying the fixed image thereon into successive lengths to provide respective copies, said electrophotographic copier comprising: means for transferring said toner powder image formed on said photoreceptor onto said copy paper; means for fixing said toner powder image on said copy paper by fusing, said fixing means at least including one heat source disposed in a position near the path of travel of said copy paper; a reflector for reflecting heat radiated from said heat source towards said copy paper, a shaft pivotally mounted on said fixing means, a member fixedly secured to said shaft and supporting said reflector and said heat source, a lever fixedly secured to said shaft; means for urging said shaft to rotate in one pivotal direction for pivoting said heat source away from the path of the copy paper; means releasably contacting said lever for preventing said shaft from being pivoted by said menas for urging said shaft to rotate until said means is actuated to release said lever; means for driving said shaft in the longitudinal direction thereof for disengaging said lever from said means releasably contacting said lever for permitting said urging means to pivot said shaft in said one pivotal direction; at least one pair of transferring rolls for forward transporting of said copy paper carrying said fixed image thereon; and means for cutting said copy paper carrying said fixed image thereon into sheet-size lengths, said cutting means being disposed at a forward position with respect to the position of said pair of rolls in said path of travel of said copy paper.

6. An electrophotographic copier for transferring an original image onto a copy paper continuously fed from a roll by a process including the steps of electrostatically charging a photoreceptor, exposing said original image onto said electrostatically charged photoreceptor to form an electrostatic latent powder image, electrostatically transferring said toner powder image onto said copy paper, fusing said toner powder image on said copy paper to fix it thereon, and cutting said copy paper carrying the fixed image thereon into successive lengths to provide respective copies, said electrophotographic copier comprising: means for transferring said toner powder image formed on said photoreceptor onto said copy paper; means for fixing said toner powder image on said copy paper by fusing, said fixing means at least including one heat source disposed in a position near the path of travel of said copy paper; a reflector for reflecting heat radiated from said heat source towards said copy paper, a shaft pivotally mounted on said fixing means, a member fixedly secured to said shaft and supporting said reflector and said heat source, a lever fixedly secured to said shaft, means for urging said shaft to rotate in one direction for pivoting said heat source away from the path of the copy paper, and a reciprocal member contacting said lever and reciprocally movable between a first position during operation of the apparatus and a second position during cessation of operation of the apparatus, and in said first position engaging said lever for causing said shaft to occupy a pivotal position in which it is pivoted as far as it can in the other direction against the force of the means for urging said shaft to rotate, and in said second position freeing said lever for permitting said shaft to be pivoted as far as it can in said one direction by said means for urging said shaft to rotate, at least one pair of transferring rolls for forward transporting of said copy paper carrying said fixed image thereon; and means for retracting said toner powder image transferring means from said photoreceptor when the respective transferring processes are over, said reciprocal member being on said toner powder image transferring means, whereby movement of said transferring means to the retracted position moves said reciprocal member away from said lever as said reciprocal member is moved away from said lever and said lever is free to move to said second position.

* * * * *